US006915797B1

(12) United States Patent
Lightbourne

(10) Patent No.: US 6,915,797 B1
(45) Date of Patent: Jul. 12, 2005

(54) PORTABLE KITCHEN FOR PREPARING AND STORING FOODS OR THE LIKE

(76) Inventor: Dilton A. Lightbourne, 29 Rockland Estates, Warwick, WK07 (BM)

( * ) Notice: Subject to any disclaimer, the term of this patent is extended or adjusted under 35 U.S.C. 154(b) by 0 days.

(21) Appl. No.: 10/772,942

(22) Filed: Feb. 4, 2004

(51) Int. Cl.[7] ..... F24B 1/08
(52) U.S. Cl. ..... 126/9 R
(58) Field of Search ..... 126/9 R, 37 B, 126/37 R, 39 B

(56) References Cited

U.S. PATENT DOCUMENTS

| | | | | |
|---|---|---|---|---|
| 3,171,700 A | | 3/1965 | Parsell et al. | |
| 3,489,267 A | | 1/1970 | Carpenter | |
| 3,692,975 A | * | 9/1972 | Markus et al. | 219/202 |
| 4,143,902 A | * | 3/1979 | Johnstone | 296/167 |
| 4,706,817 A | | 11/1987 | Greathouse | |
| 5,257,509 A | | 11/1993 | Harris | |
| 5,579,914 A | | 12/1996 | Thore | |
| 5,589,958 A | * | 12/1996 | Lieb | 349/16 |
| 6,079,400 A | | 6/2000 | Tomat Dany | |
| 2004/0026946 A1 | * | 2/2004 | Reed et al. | 296/24.3 |

* cited by examiner

*Primary Examiner*—Stephen Gravini
(74) *Attorney, Agent, or Firm*—Abelman, Frayne & Schwab

(57) ABSTRACT

A portable kitchen, which includes a case having at least one cover movable between closed and open positions, the closed position being for compact containment of contents therein, and the open position exposing the contents for use. A plurality of functional food preparation and storage devices are supported within the case, including: a refrigerator unit capable of containing and storing foods a conventional refrigerator storage temperatures; and a microwave power unit for microwave heating of foods; a cooking unit having cooking burners for heating cookware or the like for preparing heated foods. A power connecting device is provided for connecting an outside source of power to the food preparation and storage devices to provide functioning power to the devices.

18 Claims, 2 Drawing Sheets

A.C. OUTLET
D.C. OUTLET

PORTABLE KITCHEN FOR PREPARING AND STORING FOODS OR THE LIKE

BACKGROUND OF THE INVENTION

1. Field of the Invention

The present invention relates generally to a portable kitchen for preparing and storing food products of the like, contemplated primarily for use in the field. The kitchen is contained within a portable suitcase-type carry bag and includes power adapters which render the kitchen operable away from the home as well as in the home.

2. Description of the Prior Art

In the past attempts have been made to provide kitchen devices in portable units for purposes of availability and convenience, primarily away from home, but also for use within the home, when needed. Certain attempts included actual certain kitchen utilities such as burners for cooking and preparing hot foods and utensils used for preparing and serving the foods. Many of such attempts have included portable containers for supporting the storage of the functional items used for preparing and serving the food.

One example of a portable kitchen is disclosed in U.S. Pat. No. 6,079,400 wherein a portable camp kitchen comprises a cooker unit with a burner and a container member adapted to contain the cooking unit integrally with the latter. The cooker unit is mounted on a frame which is in turn supported on rotatable support members. Another example of a camper style kitchen caddy is disclosed in U.S. Pat. No. 5,579,914 which relates to a camper kitchen caddy having a carrying case which includes various food preparation items mounted thereon. U.S. Pat. No. 5,257,509 relates to a convertible briefcase, food and beverage carriage, and mini-cooler in which a container is convertible between a briefcase, a food and beverage carriage, and a mini-cooler. U.S. Pat. No. 4,706,817 relates to a portable food holding device comprising a table section with foldable legs and a cover attached thereto. U.S. Pat. No. 3,489,267 relates to a cooking unit for campers and the like intended to enable the use of various utensils in combination with other utensils and compact packing of the whole. The combination of elements disclosed include at least one first utensil, a second utensil, and a third utensil, whereby the third utensil can serve as a cover for the first utensil and so can a second utensil, and a second utensil can also serve as a cover for a third utensil, and the three can be put together with the second utensil sandwiched between the first utensil and the third utensil. Lastly, U.S. Pat. No. 3,171,700 relates to a bar cabinet of the type having hinge means pivotally connecting two sections which form an enclosure for bar implements, bottles and the like.

While the prior art includes various attempts to provide kitchen-type devices with portability, none relate to a device which provides the scope of function and utility to prepare and store foods with efficiency, away from the home, as well as within the home, and with various power adapter capabilities to provide the requisite heating and cooling functions for preparation and storage of foods. I have invented a portable mini-kitchen which includes kitchen-type appliances generally needed for the preparation and storage of foods, with multiple energy adapters for use with various power sources within and away from the home.

SUMMARY OF THE INVENTION

The present invention relates to a portable kitchen, which comprises a case having at least one cover movable between closed and open positions, the closed position being for compact containment of contents therein, and the open position exposing the contents for use. A plurality of functional food preparation and storage devices are supported within the case, including a refrigerator unit capable of containing and storing foods at conventional refrigerator storage temperatures, a microwave power unit for microwave heating of foods, and a cooking unit having cooking burners for heating cookware or the like for preparing heated foods. The invention further comprises a power connecting device for connecting an outside source of power to the food preparation and storage devices to provide functioning power to the devices.

The power connecting device is preferably at least one of a direct current (i.e., D.C.) connecting device and an alternating current (i.e., A.C.) connecting device. The refrigerator unit is capable of maintaining food items at conventional refrigeration temperatures, i.e., between about 34° F. and about 46° F., and more particularly, between about 36° F. and about 40° F., when supplied with power.

The microwave power unit includes at least one pivotable access door for gaining access to a central food heating section, the access door having a glass viewing panel which permits viewing of an internal microwavable heating section. The microwave power unit may also include at least two pivotable access doors for gaining access to a central food heating section, each said access door having a glass viewing panel.

The portable kitchen further comprises a toaster device supported by the case for toasting food items. Further the refrigerator unit is preferably positioned adjacent the microwave unit, each being insulated from the other by a heat insulating wall. The microwave unit may be positioned adjacent the cooking unit, each separated from the other by a heat insulating wall.

The portable kitchen further comprises a storage space and a plurality of support shelves for supporting utensils, equipment, food or the like. Further, the power connecting device is preferably a power inverter having a power cord for connection to a direct current (i.e., D.C.) source. The power cord preferably includes a device for connection to a cigarette/cigar lighter of a motorized unit.

The motorized unit may be an automobile, SUV, RV, mini-van, boat or the like. Further, the power connecting device may also be a power connection device having a power cord adapted for connection to a conventional alternating current (i.e., A.C.) power source. Further, the power cord may also include a connection device at one end for insertion into an alternating current (i.e., A.C.) power source, such as a standard wall duplex outlet.

DETAILED DESCRIPTION OF THE PREFERRED EMBODIMENTS

Figures 1, 2:
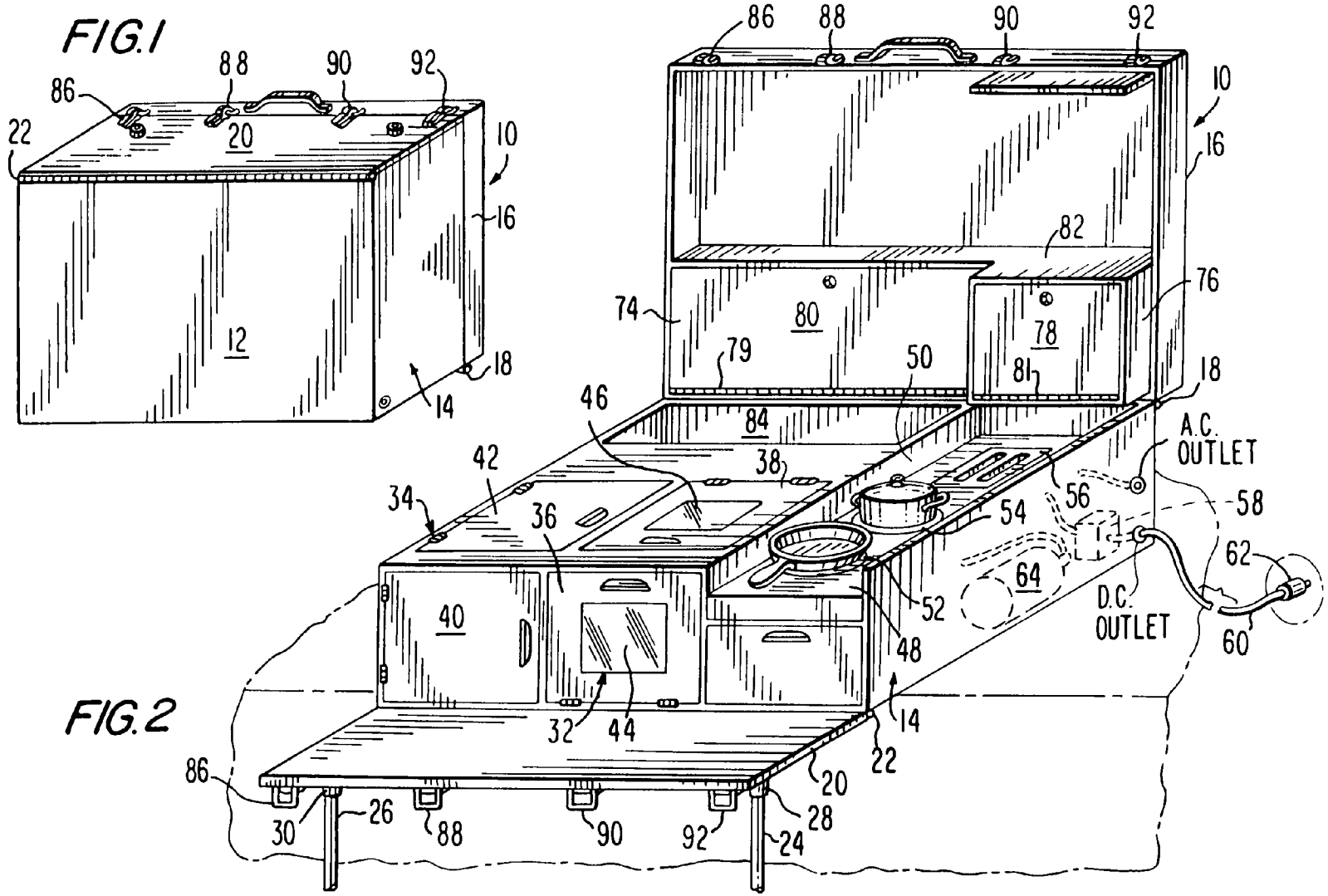
FIG. 1 is a top and right side perspective view of a portable kitchen for preparing and storing foods or the like constructed according to the present invention.
FIG. 2 is a top and right side perspective view of the portable kitchen shown in FIG. 1 in the open condition, illustrating the functional food preparation and storage facilities, the device being ready for use in preparing and/or storage of foods.

Referring initially to FIG. 1 there is shown a portable kitchen 10 for preparing and storage of foods or the like constructed according to the present invention. The portable kitchen 10 is contained within a carry case 12 having a structure and functional arrangement similar to the structure of a suitcase or briefcase, wherein a main case 14 has a cover 16 pivotably attached thereto by hinge 18 as shown. Front cover 20 is also pivotably attached by hinge 22 as shown in FIG. 1. The function and arrangement of each of these items will be more fully described in connection with FIGS. 2 and 3.

Referring now to FIG. 2 there is illustrated the portable kitchen shown in FIG. 1 with the covers pivotably rotated to the operative position. In particular, the case 14 includes pivotable support tray 20 which may be rotated 90° (degrees) downwardly about hinge 22 and supported on a pair of vertical support members 24,26 placed on the ground, as shown. Support members 24,26 may be attached to the front surface of support shelf 20 by threaded connections with female threaded collar members 28,30, or otherwise be made to support tray 20. The top cover 16 is shown pivotably rotated upwardly approximately 90 degrees relative to the main case 14 about hinge 18 so as to permit full display of the kitchen appliances and utensils as shown in the drawings, as well as an array of storage units as shown.

Referring once again to FIG. 2, the main case 14 includes a microwave unit 32 and refrigerator unit 34. The microwave unit is accessible through vertical front door 36 or horizontal top door 38. Each door 36,38 of the microwave unit respectively includes a glass viewing panel 44,46 as shown. The refrigerator unit 34 is accessible by a vertical front door 40 or alternatively by a horizontal top door 42.

A cooking unit 48 is provided adjacent and immediately to the right of the microwave unit 32, and separated by a wall 50 which is preferably provided with an insulating medium (not shown) to separate the cooking element from the microwave unit. In addition, an insulating wall is provided between the microwave unit 32 and the refrigerator unit 34, but is not shown.

Referring once again to the cooking unit 48, there are provided several burners 52, 54 for heating cookware to prepare foods. In addition, toaster 56 for preparing toast or the like, is provided behind burner 54.

As can be seen in the drawings, each of the powered units, including the microwave 32, the refrigerator 34, the cookware unit 48, and the toaster unit 56 are powered by a connecting device in the form of an inverter 58 which in turn is provided with a power source from a cigarette lighter of a motor vehicle by a power connection cord 60 as shown. Power connection cord 60 includes an appropriate jack 62 which may be inserted into the cigarette/cigar lighter of a motor vehicle (not shown). The power inverter unit 58 is shown schematically in dash lines and may be one of various types available on the market which are usable with SUV's, RV's, mini-vans, automobiles, boats or the like. Power inverters available on the market are provided under the trademark Prosine Wave Inverters. Power inverters such as Prosine Power and X Power Inverters 1750 plus marketed by Xantrex are also contemplated. Alternative power jacks and power sources are also contemplated, depending upon local availability and designs.

As can be seen in FIG. 2, the power connector cord 60 which includes cigarette lighter adapter 62 is connected to the power inverter and provides the appropriate internal power source for the cookware unit, the microwave, the refrigerator and the toaster.

As can also be seen from FIG. 2, an alternative source of power can be provided by way of a bottled gas 64 which is shown in dash lines and which can alternatively be connected as a power source to the appliance units in a known manner. In FIG. 2 there is also illustrated an alternating current outlet adapter which is denoted "A.C. (i.e., alternating current) outlet" which will be further described in conjunction with the embodiment shown in FIG. 3.

Figure 3:
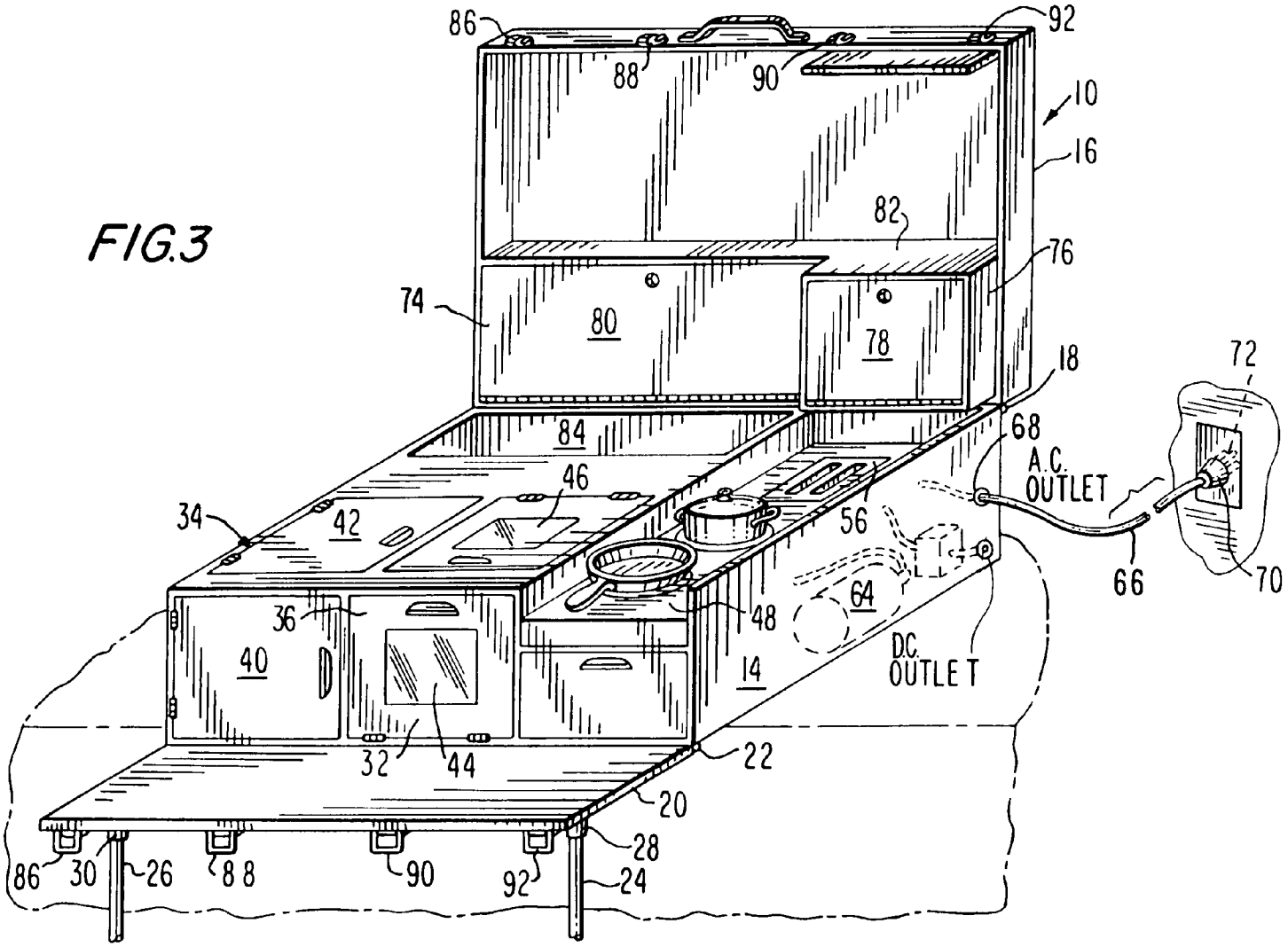
FIG. 3 is a top and right side perspective view of the portable kitchen shown in FIG. 2 illustrating the incorporation and use of an alternative source of power for food preparation and storage.

Referring now to FIG. 3, there is disclosed a portable kitchen similar to the embodiment shown in FIG. 2, wherein most or all of the elements and components are identically numbered to those of FIG. 2. The distinction between the embodiment of FIG. 2 and that of FIG. 3 is that the embodiment of FIG. 2 utilizes an A.C. adapter power cord 66 which includes an appropriate jack or connector 68 at one end for insertion into the A.C. outlet opening in the portable kitchen case 14, and at the other end, an A.C. plug 70 adaptable for use in conjunction with a conventional wall mounted A.C. duplex unit 72 of the type generally found in homes, garages or the like. In use, where conventional power sources are available through an alternating current outlet 72 as shown in FIG. 3, the appropriate A.C. connecting wire is inserted into the A.C. outlet opening 68 of the portable kitchen after the connector cord 60 (which is used in conjunction with a vehicle power source and inverter 58) is removed from the device. The appropriate internal power connections are incorporated for conversion either by a switch (switch not shown) or by directing the power units directly to the appropriate connections in each of the appliances. In all other respect the embodiment of the portable kitchen is the same as in the embodiment shown in FIG. 2.

Referring now once again to the portable kitchen shown in FIGS. 2 and 3, there is illustrated a pair of storage cabinets 74,76 mounted on cover 16, each storage cabinet respectively including a pivotable door 78,80 as shown for pivotable movement downwardly about respective hinge 79,81, to an open position whereby access to the storage cabinet is available. The storage cabinet also includes a shelf 82 for supporting food, utensils or the like during and after food preparation. An additional storage unit or well-type opening 84 is included in the main case 14 immediately behind the microwave unit 32 and refrigerator unit 34.

As can be seen from the drawings, the suitcase type cover 16 can be pivotably rotated downwardly, while the shelf 20 can be pivotably rotated upwardly so that they meet and join and are connected by appropriate locking mechanisms 86,88,90 and 92 as shown, to connect and return the suitcase to the closed compact condition shown in FIG. 1.

In operation the portable kitchen can be utilized to prepare and store foods in locations away from home as well as within the home, if required, through the usage of a power supply from an SUV, RV, mini-van, automobile, boat or the like, or thorough a conventional source of power is shown in FIG. 3. The portable kitchen storage space 84, as well as the cabinets 74,76, can be utilized to include storage of utensils, pots, pans or the like when kitchen is not in use. Alternatively, the space 84 can be used to store foods.

It can be seen that the portable kitchen of the present invention is a self-contained unit which can be made to store utensils, kitchen equipment or the like, and can be readily powered for use as a whole or for use as a substitute of a full-size kitchen away from the home or within the home.

What is claimed is:

1. A portable kitchen, which comprises:

a) a case having at least one cover movable between closed and open positions, the closed position being for compact containment of a plurality of functional food preparation and storage devices supported within said case and entirely hidden by the at least one cover when in the closed position, and the open position being for exposing at least one of the plurality of functional food preparation and storage devices from the compact containment and exposing the plurality of functional food preparation and storage devices for use:

b) the plurality of functional food preparation and storage devices supported within said case, including:

1) a refrigerator unit for containing and storing foods, said refrigeration unit cooling and maintaining the foods at conventional refrigerator storage temperatures;

2) a microwave power unit to microwave heat foods; and 3) a cooking unit having cooking burners for heating cookware and foods for preparation thereof; and c) a power connecting device connectable to an outside source of power to said food preparation and storage devices to provide functioning power to said devices.

2. The portable kitchen according to claim 1, wherein said power alternating current (i.e., A.C.) connecting device.

3. The portable kitchen according to claim 2, wherein said refrigerator unit is capable of maintaining food items at between about 34° F. and about 46° F., when supplied with power.

4. The portable kitchen according to claim 3, wherein said microwave power unit includes at least one pivotable access door for gaining access to a central food heating section.

5. The portable kitchen according to claim 4, wherein each said microwave access door has a glass viewing panel which permits viewing of an internal microwavable heating section.

6. The portable kitchen according to claim 5, wherein said microwave power unit includes at least two pivotable access doors for gaining access to a central food heating section, each said access door having a glass viewing panel.

7. The portable kitchen according to claim 6, further comprising a toaster device supported by said case for toasting food items.

8. The portable kitchen according to claim 7, wherein said refrigerator unit is positioned adjacent said microwave unit, each being insulated from the other by a heat insulating wall.

9. The portable kitchen according to claim 8, wherein said microwave unit is positioned adjacent said cooking unit, each separated from the other by a heat insulating wall.

10. The portable kitchen according to claim 9, further comprising a storage space and a plurality of support shelves for supporting utensils, equipment, or food.

11. The portable kitchen according to claim 10, wherein said power connecting device is a power inverter having a power cord for connection to a direct current (i.e., D.C.) source.

12. The portable kitchen according to claim 11, wherein said power cord includes a device for connection to a cigarette/cigar lighter of a motorized unit.

13. The portable kitchen according to claim 12, wherein said motorized unit is an automobile, SUV, RV, mini-van, or a boat.

14. The portable kitchen according to claim 10, wherein said power connecting device is a power connection device having a power cord adapted for connection to a conventional alternating current (i.e., A.C.) power source.

15. The portable kitchen according to claim 14, wherein said power cord includes a connection device at one end for insertion into an alternating current (i.e., A.C.) power source.

16. The portable kitchen according to claim 15, wherein said A.C. power source is a standard wall duplex outlet.

17. A portable kitchen, which comprises:

a) a case having at least a pair of covers pivotably movable between closed and open positions, the closed positions of said covers being for compact containment of a plurality of functional food preparation and storage devices supported within said case and entirely hidden by said covers when in the closed positions, and the open positions being for exposing the plurality of functional food preparation and storage devices from the compact containment and exposing the plurality of functional food preparation and storage devices for use:

b) the plurality of functional food preparation and storage devices supported within said case, including:

1) a refrigerator unit for containing and storing foods, said refrigeration unit cooling and maintaining the foods at conventional refrigerator storage temperatures;

2) a microwave power unit to microwave heat foods; and 3) a cooking unit having cooking burners for heating cookware and foods for preparation thereof; and c) a power connecting device connectable to an outside source of power to said food preparation and storage devices to provide functioning power to said devices.

18. A portable suitecase type kitchen, which comprises:

a) a portable case having a carry handle and at least a pair of hinged covers pivotably movable between closed and open positions, the closed positions of said covers being for compact containment of a plurality of functional food preparation and storage devices supported within said case and entirely hidden by said covers when in the closed positions, and the open positions being for exposing the plurality of functional food preparation and storage devices from the compact containment and exposing the plurality of functional food preparation and storage devices for use:

b) the plurality of functional food preparation and storage devices supported within said case, including:

1) a refrigerator unit for containing and storing foods, said refrigeration unit cooling and maintaining the foods at conventional refrigerator storage temperatures;

2) a microwave power unit to microwave heat foods, said microwave power unit having a front glass viewing panel and being positioned adjacent said refrigerator unit and separated therefrom by an insulating wall; and 3) a cooking unit having cooking burners for heating cookware and foods for preparation thereof, said cooking unit positioned adjacent said microwave unit and separated therefrom by an insulating wall; and c) a power connecting device connectable to an outside source of power to said food preparation and storage devices to provide functioning power to said devices.

* * * * *

UNITED STATES PATENT AND TRADEMARK OFFICE

CERTIFICATE OF CORRECTION

PATENT NO. : 6,915,797 B1
DATED : July 12, 2005
INVENTOR(S) : Dilton A. Lightbourne It is certified that error appears in the above-identified patent and that said Letters Patent is hereby corrected as shown below:

Column 5,
Lines 26-27, should read:
2. The portable kitchen according to claim 1, wherein said power connecting device is at least one of a direct current (i.e., D.C.) connecting device and an alternating current (i.e., A.C.) connecting device.

Signed and Sealed this

Third Day of January, 2006

JON W. DUDAS
*Director of the United States Patent and Trademark Office*